United States Patent [19]

Rhoades

[11] Patent Number: 4,936,057

[45] Date of Patent: Jun. 26, 1990

[54] METHOD OF FINISH MACHINING THE SURFACE OF IRREGULARLY SHAPED FLUID PASSAGES

[75] Inventor: Lawrence J. Rhoades, Pittsburgh, Pa.

[73] Assignee: Extrude Hone Corporation, Irwin, Pa.

[21] Appl. No.: 773,540

[22] Filed: Sep. 9, 1985

Related U.S. Application Data

[63] Continuation-in-part of Ser. No. 747,519, Jun. 21, 1985, abandoned.

[51] Int. Cl.[5] ..... B24B 57/02

[52] U.S. Cl. ..... 51/317; 51/7

[58] Field of Search ..... 51/317, 2, 7, 17

[56] References Cited

U.S. PATENT DOCUMENTS

| | | | |
|---|---|---|---|
| 3,521,412 | 4/1968 | McCarty | 51/317 |
| 3,583,103 | 6/1971 | Rystrom | 51/317 |
| 3,953,410 | 7/1971 | Taylor | 51/317 |

FOREIGN PATENT DOCUMENTS

| | | | |
|---|---|---|---|
| 675643 | 7/1952 | United Kingdom | 51/7 |

*Primary Examiner*—Robert P. Olszewski

*Attorney, Agent, or Firm*—Waldron & Associates

[57] ABSTRACT

The present invention is based upon the performance of abrasive flow machining through pump casings and, more particularly, through volute casings whereby the internal surface friction of the casing is substantially reduced to consistently effect a minimal internal friction, operation after operation, and whereby the industry standards for internal friction values for pumps may be established.

11 Claims, 7 Drawing Sheets

METHOD OF FINISH MACHINING THE SURFACE OF IRREGULARLY SHAPED FLUID PASSAGES

This is a continuation-in-part of copending patent application, Ser. No. 747,519, filed June 21, 1985, now abandoned.

BACKGROUND OF THE INVENTION

A pump may be defined as a machine or apparatus which imparts energy to a fluid flowing therethrough. All pumps basically fall into one of two categories or types of pumps: positive displacement pumps and dynamic pumps.

Positive displacement pumps embody one or more chambers and operate by forcing a set volume of fluid from the inlet pressure section of the pump into the discharge portion of the pump, i.e., alternating action of filling and emptying the chamber or chambers with the fluid. Representative types of positive displacement pumps include reciprocating pumps such as those having piston/plunger type construction, metering construction and diaphram construction, and rotary pumps such as those having screw rotor type construction and intermeshing gear wheel construction. Reciprocating pumps operate intermittently whereas rotary pump operate continuously.

Dynamic pumps operate by developing a high fluid velocity and converting the velocity into pressure in a diffusing flow passage. Representative types of dynamic pumps include horizontal or vertical centrifugal pumps, axial pumps and turbine pumps.

Centrifugal pumps comprise a wide class of pumps which in their most essential form consist of two basic components. A first component comprises a rotating element, including an impeller mounted on a shaft which is in turn supported by bearings and driven through a flexible or rigid coupling by a driver. A second component comprises a stationary element comprised of a casing, stuffing box and bearings. The casing includes suction and discharge nozzles, supports the bearings, and houses the rotor assembly.

As fluid enters a centrifugal pump, it is forced by atmospheric or other pressure into a set of rotating vanes which constitute an impeller. The impeller imparts tangential acceleration to the fluid and discharges the fluid at a relatively high velocity at its periphery. The velocity of the fluid is then converted into pressure energy or pressure head by means of a volute or by a set of stationary diffuser vanes surrounding the impeller periphery. Pumps having volute casings are generally referred to as volute centrifugal pumps, and pumps having diffuser vanes are generally referred to as diffuser pumps. Since centrifugal pumps have no valves, fluid flow is uniform and free of low-frequency pulsations.

In a closed system such as a centrifugal pump, the principle of conservation of energy states that the total energy input is equal to the total energy output from that system. Bernoulli's equation in its more general form for total mechanical energy balance can be stated as follows:

$$P_1+Z_1+V_1+E_p=P_2+Z_2+V_2+F_L \qquad \text{Eq. 1}$$

where $P_1$ is pressure energy at the point of entrance, $Z_1$ is potential energy at the point of entrance, $V_1$ is kinetic energy or velocity head at the point of entrance, $E_p$ is pump energy, $P_2$ is pressure energy at the point of exit, $Z_2$ is potential energy at the point of exit, $V_2$ is kinetic energy or velocity head at the point of exit, and $F_L$ is friction loss between the point of entrance and point of exit.

In order to determine the power requirement of a given pump, Bernoulli's equation can be used in the following restated form:

$$E_p=(P_2-P_1)+(Z_2-Z_1)+(V_2-V_1)+F_L \qquad \text{Eq. 2}$$

It is readily apparent that if friction loss ($F_L$) can be reduced within a given pump, the power requirement for that pump will also be reduced, and considerable savings in operation costs can be realized.

Those skilled in the art have long known that if the friction of a fluid flow through the interior of a centrifugal pump were reduced, the savings in terms of reduced power requirement would be substantial. Since most, if not all centrifugal pump casings are cast-metal, the interior surface of the casings contain variations including surface roughness, pits, nicks, gouges, blow holes, or positive metal. All of these variations will substantially impede fluid flow, i.e., result in substantial friction loss.

Up to now, the only means of remedying these surface variations consisted of manual operations including the utilization of files and rotary burr tools, sanding and grinding. These methods, however, are effective largely as corrective measures for gross variations or imperfections. Single cast pump casings present another problem in that the interior surface of the casing is largely inaccessible to manual operations. Even where the interior surface of the casings is accessible, the difficulty of manual operations in terms of control, uniformity and the degree of physical dexterity required renders the finish on the interior surface of a so-called "finished" casing largely untreated. Further, performance of manual operations on the interior surface of a pump casing is a time consuming task and renders the "finished" article quite expensive.

The present practice by industry is to accept the internal surface variations of casings as unavoidable and compensate for the energy loss due to friction by utilizing drivers with increased power output capabilities. The result is a higher cost of operation which is attributable to higher energy requirements and higher maintenance costs due to increased wear and stress on the moving parts of the pump.

The foregoing serves to illustrate the state of the art and the problem addressed and solved by the present invention.

It is an object of the present invention to provide a method of working the interior surface of pump casings to reduce internal fluid flow friction of dynamic pumps.

It is a further object to provide such a method to reduce the internal fluid flow friction of centrifugal volute pumps.

Another object is to provide a method of providing and ensuring a consistent level of minimal internal fluid flow friction of dynamic pumps.

Still another object is to provide a method of providing and ensuring a uniform level of minimal internal fluid flow friction of centrifugal volute pumps.

Yet another object is to provide a method of providing industry with a standard of minimal internal fluid flow friction of dynamic pumps.

Another object is to provide a method of providing industry with a standard of minimal internal friction of centrifugal volute pumps.

A further object is to provide parts and components which have been worked to effect minimal internal fluid flow friction in dynamic pumps.

A further object is to provide parts and components which have been worked to effect minimal internal fluid flow friction in centrifugal volute pumps.

SUMMARY AND BRIEF DESCRIPTION OF THE INVENTION

The present invention is based upon the performance of abrasive flow machining through pump casings and, more particularly, through volute casings whereby the internal surface friction of the casing is substantially reduced to consistently effect a minimal internal friction, operation after operation, and whereby the industry standards for internal friction values for pumps may be established.

BRIEF DESCRIPTION OF THE DRAWINGS

FIG. 5 is a cross-sectional view of a centrifugal pump with the impeller removed and with the restrictive fixture in place.

FIG. 3 is a cross-section view of a centrifugal pump with the impeller removed showing an alternate embodiment of the restrictive fixture.

FIG. 4 is a sectional view taken generally along line 4—4 of FIG. 3 showing the mounting plate, inlet passageway and peripheral passageway.

DETAILED DESCRIPTION OF THE INVENTION

Figure 1:
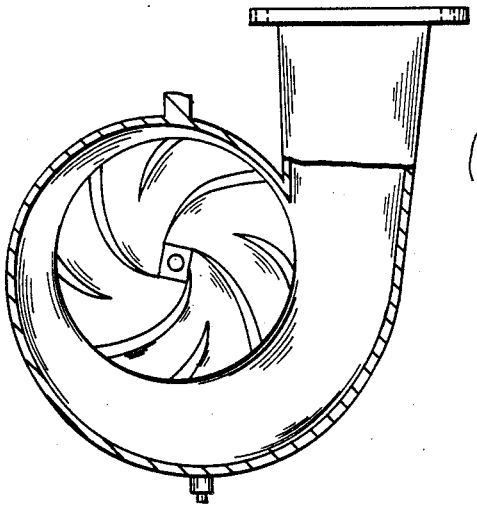
FIG. 1 (Prior Art)
FIG. 1 is a side, cross-sectional view of a typical centrifugal pump showing the impeller, casing and volute.
Figure 2:
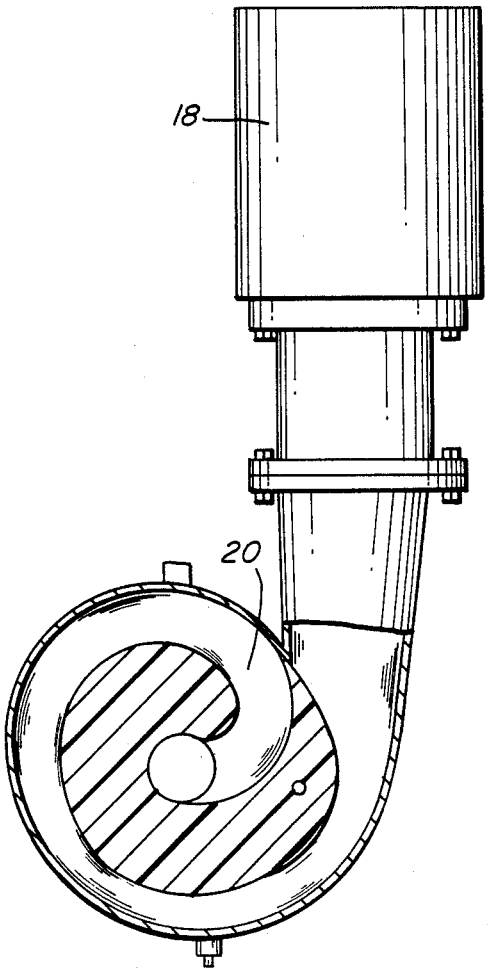
FIG. 2 is a cross-sectional view of a centrifugal pump with the impeller removed and with the restrictive fixture in place.

Abrasive flow machining is a process for working metals and related materials. It is particularly useful for machining and honing the edges and surfaces of such materials. Some of the operations realizable using this process include deburring, radiusing, resizing, polishing and other related material finishing operations.

Unlike any other machining process, abrasive flow machining employs non-Newtonian semi-solid polymer compositions as the abrasive carrying medium. The physical properties of this medium include viscoelasticity and rheological dilatancy. Accordingly, the viscosity of the medium increases with increased shear stress, and when the shear is removed, the viscous properties return wholly or partially to their original state. It is therefore apparent that abrasive flow machining as employed in the present method does not include flow of abrasives suspended or slurried in fluid media such as cutting fluids, honing fluids, gas streams and the like, but rather is limited to non-Newtonian semi-solid polymer compositions which form stable, non-separating intermixtures with solid particulate abrasives whose flow is characterized by rheological dilatancy.

The rheopetic medium employed in the present method enables substantially non-abrasive flow at low shear conditions by plastic deformation, and substantially high abrasive flow by quasi-solid plug flow properties when shear conditions are high. Accordingly, abrasion is effected only on those surfaces or areas where high shear conditions exist. Other surfaces or areas having low shear conditions are relatively unaffected.

The medium employed in the present method is a semisolid, visco-elastic, rheopectic polymer material which has the consistency of putty. It is important to note that the medium used must have sufficient body at high pressure and low velocity to provide backing for the abrasive particles so that the abrasive particles are pressed against the surface to be treated with sufficient force to obtain the desired result. One suitable medium is silicone putty, i.e., borosiloxane, of a grade indicated by the General Electric Company as SS-91. This material has a bounce or rebound of 25 to 50 percent when a twelve gram ball of the putty at 70 to 78 degrees Fahrenheit is dropped from a height of 100 inches onto a smooth surfaced soapstone block. This material has a resilience of 10 to 20 percent when measured with a Bashore Resiliometer of the Precision Scientific Company of Chicago, at room temperature and with a special one-half ounce drop weight. This material has a penetration of 1.5 to 10 mm. in five seconds when measured with a Precision Universal Penetrometer with a one-quarter inch diameter foot on a 47.5 gram test rod with no external loading. These tests were made at least twenty-four hours after the batch of putty was dropped or first formed in order to ensure reliable testing results.

Silicone putty, by strict definition, is a solid. It exhibits, however, many characteristics of a fluid. It is compressible and, therefore, expandable. Under pressure, it becomes less flowable and behaves more like a solid. It conforms exactly to whatever confines it, and thus, ensures abrasion of all surface areas of the passageway wherever high shear conditions exist, i.e., passageway areas where flow is restricted and/or peripheral passageway areas where changes in the direction of flow occur.

Additives can be added to the putty to render it more plastic and flowable or more stiff and tough and less flowable, depending on the desired flowability. For example, a small amount of plasticizer or softener can be added to the putty to render it slightly more plastic and flowable than when it was originally dropped or formed. If stiffening or more toughness and, therefore, less flowability is desired, a hardening agent such as tetrafluoroethylene, more commonly known as Teflon, in the form of small beads, powder or levigated talc can be added to the putty.

The abrasive used with the medium will, of course, depend upon the result desired. A suitable abrasive for use in working on steel is silicon carbide. A widely used abrasive is aluminum oxide. Other suitable abrasives include boron carbide, titanium carbide, diamond dust, rouge, corrundum, garnet, alundum, glass and, in certain applications, softer materials such as fiber or shell material. Normally, the content of abrasive material per part of putty material will be from about two parts to about fifteen parts by weight. Typically, abrasive particle size range from 1000 mesh to 8 mesh. Larger size abrasive particles effect deeper cuts per grain. Accordingly, if faster cutting time with possibly a rougher final surface finish is desired, larger size abrasive particles would be suitable. Depending on the result desired, however, a mixture of abrasive particle sizes can be used with the putty.

In the present invention, it is generally desirable to employ course abrasive particles in the range between 10 mesh to 150 mesh, preferably in the range between 10 mesh and 30 mesh. Using an abrasive media containing abrasive particles of such size will effect both machining and polishing action with a smooth surface finish as the result. It is also possible to employ abrasive flow machining or polishing in multiple steps—the initial stage being conducted with an abrasive medium containing larger size abrasive particles and subsequent abrasive flow operations being conducted with abrasive media containing finer abrasive particles. Whether or not a single, double or multiple steps are used in performing abrasive flow machining or polishing will depend upon the desired result as well as considerations of efficiency. For example, a two-step operation wherein the workpiece is initially abrasive flow machined or polished with an abrasive medium containing larger size abrasive particles and then subsequently abrasive flow polished with an abrasive medium containing finer abrasive particles may be desirable where the result desired is a fine, reflective finish and the target surface of the workpiece contains multiple burrs and large imperfections.

It is to be noted that the intermixture of putty and abrasive particles should generally be of a uniform consistency in order to obtain maximum abrasion efficiency. The cutting efficiency of the intermixture of putty and abrasive particles is, however, surprisingly tolerant to material content changes. For example, the material removed by the abrasive media becomes part of the abrasive media, and the abrasive media as a whole can tolerate as much as 10 percent or higher by volume of such removed material before cutting performance is affected.

In order to apply abrasive flow machining to a workpiece, the typical practice is to hold the workpiece between a pair of hydraulically closed cylinders so as to confine, direct and restrict the media flow so that the areas or surfaces of the workpiece where abrasion is desired form the greatest restriction in the media flow path. By extruding the abrasive media back and forth across the target surface of the workpiece from one media cylinder to the other, abrasive action is produced where flow is restricted passing through or across the workpiece. Other means of confining, directing and restricting the media flow, such as single-cylinder, unidirectional media flow apparatus or multiple cylinder apparatus may also be used such as being within the ordinary skill of the art.

In the case of a substantially cylindrical pipe, the operation of polishing the wall surface of the pipe passageway is relatively easy since the cross-sectional area of the pipe passageway is uniform. This uniformity in cross-sectional area ensures uniform shear rate on the abrasive media along and throughout the length of the pipe passageway. Accordingly, abrasive action on the wall surface of the pipe passageway is uniform and can result in a highly polished wall surface. In the case of abrasive flow machining or polishing the wall surfaces of passages having varying cross-sectional areas, however, the process becomes more complicated. As previously noted, the wall surface at the point of greatest restriction within a passageway will receive the greatest amount of abrasion. In the case of passages with varying cross-sectional areas, abrasion is effected predominantly where the cross-sectional area is the least in size.

In the case of volute casings, the fluid passageway is designed with a consistently changing passage size to increase or decrease the pressure buildup of the fluid flowing through it during operation, i.e., the cross-sectional area of the fluid passageway increases from the inlet opening towards the outlet opening. To properly abrasive flow machine or polish such a passageway, the cross-sectional area must be held constant throughout the length of the passageway, i.e., the restrictiveness of the passageway must be held at a constant. If the cross-sectional area of the passageway is not held at a constant throughout the length of the passageway, then those areas with the most restrictiveness (least cross-sectional area) would experience more abrasion than the less restrictive areas (larger cross-sectional area).

In the method of this invention, a special restrictive fixture is placed within the passageway of the volute casing. This special restrictive fixture is designed to effect a constant cross-sectional area along the entire length of the passageway, i.e., the shape of the restrictive fixture corresponds obversely to the shape of the passageway so as to equalize the cross-sectional area along the entire length of the passageway. The configuration of the restrictive fixture resembles a negative image of the volute fluid passageway at reduced scale. As such, when the restrictive fixture is placed in position inside the volute casing, a gap is established between the restrictive figure and the wall of the fluid passageway of the volute casing. Accordingly, when the restrictive fixture is placed within the passageway of the volute casing, it mates with the passageway in such a way that the peripheral wall surface of the restrictive fixture and the peripheral wall surface of the fluid passageway define the boundaries of the peripheral passageway through which extrusion media travels.

The inlet for the extrusion media can be located near the center of the casing, i.e., more or less centered with the shaft, such being a convenient site for the location of an inlet. The restrictive fixture will accordingly be adapted to have an inlet opening near its center from which extends an inlet passage joining the inlet opening with the peripheral passageway.

The cross-sectional area of the inlet opening and inlet passageway is a function of the cross-sectional area of the peripheral passageway and outlet opening at the end of the peripheral passageway. In all instances, however, the cross-sectional area of the inlet opening and inlet passageway must be greater than the cross-sectional area of the peripheral passageway.

The restrictive fixture as used in the present method is formed by casting using either urethane, polyurethane, epoxy resin compounds, and other like materials. These materials are less susceptible to abrasion than the iron-cast casing. In all instances, the restrictive fixture should be made from a composition which is less susceptible to abrasion than the material of the workpiece. Otherwise, the utility lifetime of the restrictive fixture will be decreased due to increased rate of deformation.

Figure 3:
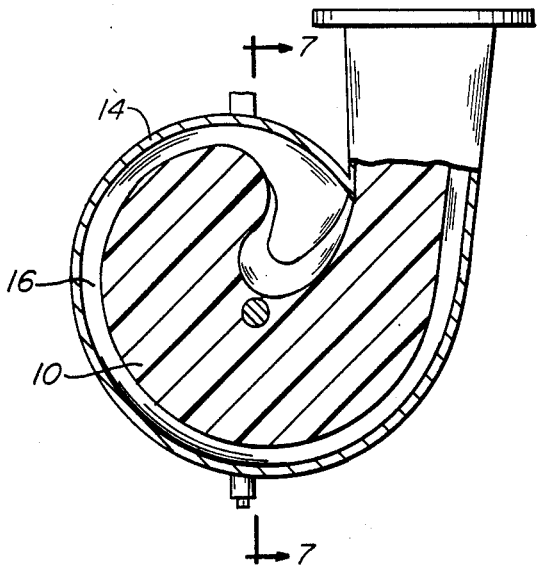
FIG. 3 is a cross-sectional view of a centrifugal pump with the impeller removed and with the restrictive fixture in place.
Figure 4:
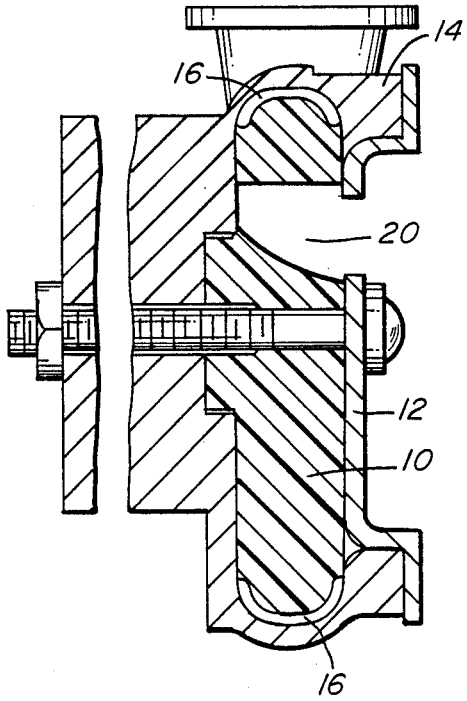
FIG. 4 a cross-sectional view of a centrifugal pump with the impeller removed and with the restrictive fixture in place.

With reference to FIGS. 3 and 4, the restrictive fixture 10 as used in the present invention is held in place by mounting the restrictive fixture 10 onto a mounting plate. The mounting plate used may be the face plate of the centrifugal pump, but other suitable means such as sealer plate 12 (FIG. 7) may be used, such being within the ordinary skill of the art. After formation and removal from the mold, the restrictive fixture 10 is mounted on a mounting plate 12, after which the mounting plate-restrictive fixture assembly is mounted on the volute casing 14. Alternatively, the volute casing 14 can be mounted on the mounting plate-restrictive fixture assembly. With the cross-sectional area of the fluid passageway 16 being now held at a constant throughout the length of the volute passageway, the surface of the fluid passageway 16 of the volute casing is ready for abrasive flow machining or polishing.

As previously noted, in order to apply abrasive flow machining or polishing to a workpiece, it is a typical practice to hold the workpiece between a pair of hydraulically closed cylinders 18 so as to confine, direct and restrict the media flow to the area or surface of the workpiece where abrasion is desired. (Only one such cylinder 18 is shown in FIG. 3 disposed above casting 14, as the second cylinder is hidden from view being disposed behind casting 14 to extrude and receive media via inlet passage 20.) By extruding the media back and forth between the two directly opposed media cylinders 18, across the target area or surface of the workpiece, abrasive action is produced where media flow is restricted passing through or across the target area or surface area of the workpiece.

Since the cross-sectional area of the fluid flow passageway 16 of a volute casing 14 fitted with a restrictive fixture is substantially equalized throughout the length of the passageway 16, abrasive flow machining or polishing can be accomplished in much the same way as with a cylindrical pipe. One opening of the volute casing 14 is fitted and sealed to one hydraulically closed cylinder 18, and the other opening of the volute casing is fitted and sealed to another hydraulically closed cylinder. Abrasive media consisting of the intermixture of putty and abrasive particles is then extruded back and forth from one media cylinder 18 to another through the peripheral passageway of the casing. Since the cross-sectional area of the peripheral passageway 16 is constant throughout the length of the passageway, restrictive forces or shear stress on the abrasive mixture remains constant and effects uniform abrasive action on the surface of the peripheral passageway 16 of the casing 14 along the entire length of the passageway.

It is to be noted that with the use of abrasive flow machining or polishing, the peripheral surface areas of the passageway where abrupt changes in flow direction occur experience more abrasion. In the case where the inlet for the extrusion media is located near the center of the casing, the restrictive fixture would, as previously noted, be adapted to have an inlet opening near its center from which extends the inlet passage joining the inlet opening with the peripheral passageway. If the inlet passage is adapted in a straight line from the central inlet opening to the peripheral passageway, thereby rendering the inlet passageway perpendicular to the peripheral passageway, then the surface area of the peripheral passageway where the inlet passage intersects with the peripheral passageway would experience greater abrasion, said intersection being where an abrupt change in flow direction occurs, e.g., almost 90° change in flow direction.

The restrictive fixture of the present invention avoids this problem of abrupt changes in flow direction by confining all such flow changes to areas within the restrictive fixture. The configuration of the inlet passage 20 within the restrictive fixture is such that the media flow where the inlet passage 20 intersects with the peripheral passageway 16 is rendered tangential to the peripheral passageway 16. Accordingly, abrasion on the surface area of the peripheral passageway 16 where the inlet passage 20 intersects with the peripheral passageway 16 is nonexcessive and uniform with abrasion on the surface area of the rest of the peripheral passageway 16.

Depending on the result desired, the extrusion pressure and operation time may be varied. For example, the extrusion pressure can be varied anywhere from 5 psi to 1800 psi. Actual extruding operation time can vary from seconds to hours. Further, the flowrate of the extruding media can also be varied to meet specific requirements.

EXAMPLE 1

A centrifugal volute pump casing 14 shown in FIG. 1 was obtained by investment casting. The casing was fitted with a mould-cast restrictive fixture 10 having a spiral configuration conforming to the interior of the volute casing by attachment of the restrictive fixture 10 onto a mounting plate 16 and fitting the restrictive fixture and mounting plate assembly onto the casing 14. The restrictive fixture 10 was cast in such size and shape so that when it was put in place inside the volute casing 14, the cross-sectional area throughout the length of the volute fluid passageway remained constant. The casing 14 was then mounted on an abrasive flow machine (not shown). The machine was loaded with an abrasive medium comprising borosiloxane loaded with 2 parts by weight of silicon carbide in a 50–50 mixture of 16 mesh and 24 mesh per part of siloxane. The casing 14 was then abrasive flow machined/polished for 50 minutes under a pressure of 600 psi. The casing 14 was then removed from the machinery, the restrictive fixture 10 removed, and then cleaned. A smooth surface finish was thus obtained on the polished area of the volute fluid passageway. The casing was assembled with the impeller and face plate and fitted for testing. The test results showed a power requirement decrease from 15 horsepower to 14 horsepower.

What is claimed is:

1. A method of abrasive flow machining the surface of irregularly shaped fluid passages comprising:
   - placing a restrictive fixture within the fluid passageway of the irregularly shaped fluid passage to equalize the cross-sectional area throughout the length of the fluid passageway;
   - extruding a visco-elastic abrasive medium through the fluid passage;
   - removing said restrictive fixture; and
   - removing said visco-elastic abrasive medium from the irregularly shaped fluid passage.

2. The method of claim 1 wherein the visco-elastic abrasive medium comprises an intermixture of abrasive particles and a semi-solid, visco-elastic, rheologically dilatant polymer material having the consistency of putty.

3. The method of claim 1 wherein the restrictive fixture comprises a mold-cast, abrasive-resistant fixture, said fixture having a configuration which is obversely related to and reduced in scale relative to the irregularly shaped fluid passage.

4. The method of claim 1 wherein the irregularly shaped fluid passage is a volute passage of a centrifugal pump.

5. The method of claim 4 wherein the restrictive fixture comprises a mold-cast, abrasive-resistant fixture having a spiral configuration.

6. The method of claim 2 wherein the semi-solid, visco-elastic, rheologically dilatant polymer material is silicone putty.

7. The method of claim 2 wherein the abrasive particle is selected from a group consisting of silicon carbide, boron carbide, aluminum oxide, titanium carbide, diamond dust, rouge, corrundum, garnet, alundum, glass, shell material and mixtures thereof.

8. The method of claim 2 wherein the size of the abrasive particles is less than 8 mesh.

9. The method of claim 1 wherein the restrictive fixture comprises an inlet passage for media flow, characterized in that the configuration of said inlet passage within said restrictive fixture renders the direction of media flow tangent with the surface of said fluid passageway in the area where said inlet passage intersects with said fluid passageway.

10. The method of claim 3 wherein the restrictive fixture comprises an inlet passage for media flow, characterized in that the configuration of said inlet passage within said restrictive fixture renders the direction of media flow tangent with the surface of said fluid passageway in the area where said inlet passage intersects with said fluid passageway.

11. The method of claim 5 wherein the restrictive fixture comprises an inlet passage for media flow, characterized in that the configuration of said inlet passage within said restrictive fixture renders the direction of media flow tangent with the surface of said fluid passageway in the area where said inlet passage intersects with said fluid passageway.

* * * * *